United States Patent [19]

van den Haak

[11] 4,089,288

[45] May 16, 1978

[54] ANCHOR WITH STABILIZATION MEMBERS

[76] Inventor: Rob van den Haak, Allegro 114, Krimpen an der Ijssel, Netherlands

[21] Appl. No.: 729,656

[22] Filed: Oct. 5, 1976

[51] Int. Cl.[2] ..... B63B 21/44

[52] U.S. Cl. ..... 114/309; 114/304; 114/310

[58] Field of Search ..... 114/301, 304–310

[56] References Cited

U.S. PATENT DOCUMENTS 49,688 8/1865 Snell ..... 114/310

2,687,106 8/1954 Linnenbank et al. ..... 114/308

*Primary Examiner*—Trygve M. Blix
*Assistant Examiner*—Sherman D. Basinger
*Attorney, Agent, or Firm*—Marn & Jangarathis

[57] ABSTRACT

In an anchor the stabilization arms transversely extending in the plane of the flukes are constructed as bars of quadrilateral cross-section having forwardly directed faces forming an acute angle with each other instead of rod-shaped. These bars are so formed that with a considerably smaller length of the stabilization arms the same stabilizing effect is obtained.

3 Claims, 3 Drawing Figures

ANCHOR WITH STABILIZATION MEMBERS

The present invention relates to an anchor comprising flukes, a shank hinged to the flukes and transversely projecting stabilization arms. Such an anchor is known from U.S. Pat. No. 3,902,466.

The stabilization arms serve to maintain the proper position of an anchor for penetration into the earth, i.e. with its ends in forward direction. For if the anchor assumes an oblique position, this will directly have an adverse effect on the penetration and hence the holding power, as the earth is moved more aside by the fluke.

The operation of the stabilization arms is as follows:

If an anchor penetrates deeper into the earth on one side than on the other, the stabilization arm on the deep side will meet with more resistance, because more earth is resting thereon, and would therefore be inhibited with respect to the other stabilization arm. The obliquely downwardly directed fluke will then penetrate less rapidly into the earth on the deeper side than the other fluke, as a result of which the fluke starts turning till the balance is restored.

Since stabilization arms project transversely from the side edges of an anchor they considerably increase the width of an anchor, which often causes great problems when handling these anchors on board supply vessels. This is particularly true of very large anchors used nowadays for anchoring drilling vessels, derricks and suchlike colossuses on the high seas. It is not impossible that the propeller of a supply vessel may be hit by a projecting part, in particular one of the stabilization arms, of the anchor when handling these large anchors. If the anchors are transported on the drilling platforms, racks for the anchors are provided on these platforms. These racks must of course be adapted to the size of the anchors and particularly to the greatest width thereof.

Another problem of the projecting stabilization arms is that the pennant wire, i.e. the steel wire with which the anchor is weighed, winds as a rule about the stabilization arms, which again creates new problems.

The object of the invention is to remove the above drawbacks. According to the invention the stabilization arms to this end formed by short bars of quadrilateral cross-section projecting at least partly from the flukes outwardly from a point inside the flukes. According to a preferred embodiment these bars are so arranged as to embrace with one end the side edges of the flukes. If the stabilization arms, hereinafter referred to as "stabs", would be mounted completely on the rear edge of the fluke, they would form shoulders which would entrain earth material, for instance sand, so that lumps will be formed, which in turn exercise pressure on the fluke, thus enhancing the instability of the fluke. To prevent this the stabs are partly mounted on the fluke and partly project therefrom. To reduce the resistance against penetration of the bars into the earth the leading faces are disposed so as to form an acute angle with the fluke surfaces. In a preferred embodiment the angle $\alpha$ between the leading faces of the bars and the flukes is between 32° and 50°.

If, as is known, the fluke is at an angle of 32° to the shank, it is advantageous when using such stabs that one of the bar faces, namely, the top face, is normal to the direction of pull, while the lower face is practically horizontally in the direction of pull and has only a slight effect on the penetration of the anchor into the earth. The angle between the leading faces and the fluke is determined during manufacture by the angle between the fluke and the shank.

As this angle is smaller in anchors used in a sand bottom than in anchors that have to work in mud ground, also the angle of the leading faces of the stabs could be changed. This is not feasible in practice, however, and a calculated angle can only be used for anchors which are permanently anchored, and where both the earth characteristics and the fluke-shank angle are known. For anchors having an adjustable fluke angle of from 32° (sand) to 50° (mud) an average angle for the stabs must be determined.

Advantages of the above-mentioned stabs over the known stabilization arms are:

a. the total anchor width can be reduced by 20% and b. the total anchor weight decreases by about 5%.

The invention will now be explained in more detail with reference to the drawings showing one embodiment by way of example.

Figure 1:
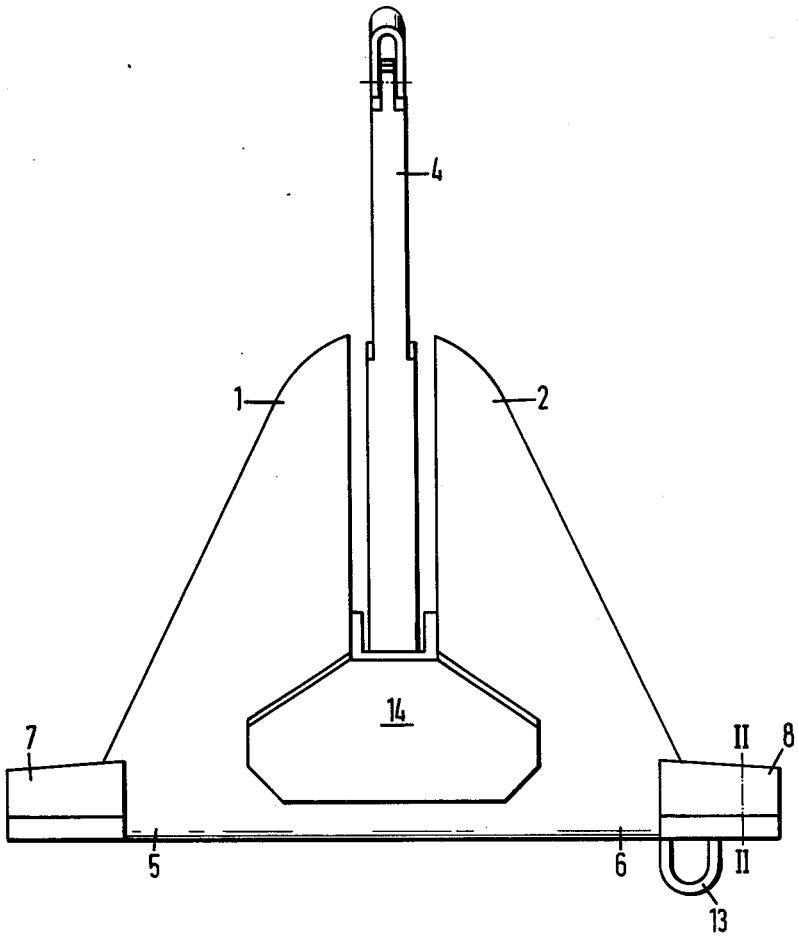
FIG. 1 is a plan view of an anchor according to the invention.
Figure 2:
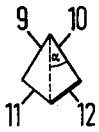
FIG. 2 is a cross-sectional view through a stabilization arm on the line II—II in FIG. 1, from which the bars of quadrilateral cross-section can clearly be seen.
Figure 3:
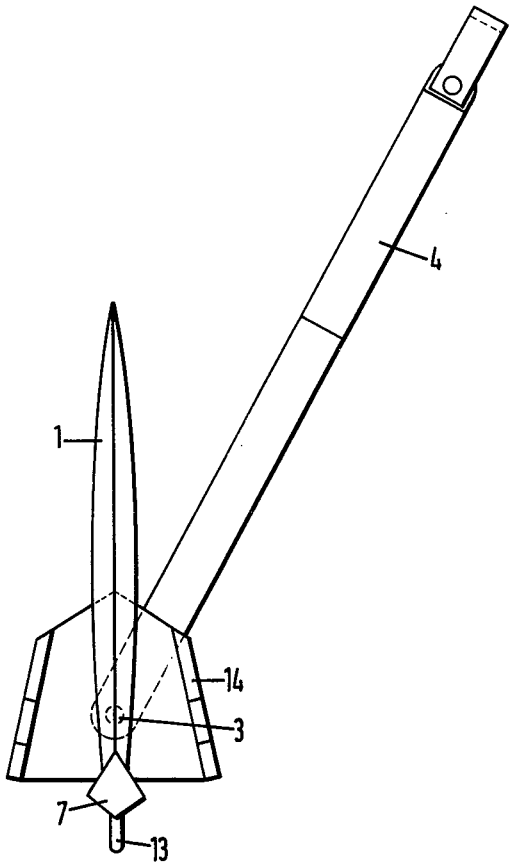
FIG. 3 shows a side elevational view of the anchor.

The anchor comprises two flukes 1 and 2 which form substantially rectangular triangles and the surfaces of which are combined to one surface behind the pivot 3 of the shank 4. As disclosed in my U.S. Letters Pat. No. 3,902,466, the pivot or hinge 3 of the shank 4 is substantially coincident with the geometric center of the fluke surface area. On corners 5 and 6 of the wide rear end of the flukes are mounted stabilization arms (7, 8). As shown in FIG. 2, these stabilization arms are quadrilateral in cross-section and the leading faces 9 and 10, respectively facing the shank form angles of, for example, 32° to the plane of the fluke. Depending on the type of anchorage ground these angles can also be increased up to 50°. The rear faces 11 and 12 of the bars form a greater angle and can also be coplanar or be formed differently. These faces do not influence the effect of the stabs.

Behind the right-hand stabilization arm 8 there is provided a padeye 13 on the fluke, in which the pennant wire for weighing the anchor can be provided.

In the center of the anchor are provided end faces 14 on both sides of pivot 3 of shank 4. Their purpose is well-known.

As can be seen from the drawings, the stabilization arms embrace with one half the edge of the fluke, while the other half projects from the fluke.

I claim:

1. An anchor comprising:

fluke means comprised of two flukes having side corners at the rear of each fluke and defining fluke surface area;

a shank pivotally mounted to said fluke means substantially coincident to the geometric center of said fluke surface area; and a stabilizer member mounted at the rear end of each fluke of said fluke means and extending outwardly from said fluke from a point inside said fluke, said stabilizer members being mounted to said fluke behind the point at which said shaft is pivotally mounted to said fluke means, said stabilizer member having leading faces at an acute angle to said flukes.

2. The anchor as defined in claim 1 wherein said leading faces of said stabilizer member have an acute angle to said fluke of from 32° to 50°.

3. The anchor as defined in claim 1 wherein a stabilizer member is provided with a pad-eye.

* * * * *